US008966807B2

(12) United States Patent
Crum

(10) Patent No.: US 8,966,807 B2
(45) Date of Patent: Mar. 3, 2015

(54) ADJUSTABLE FRONT FOCUS SIGHT FOR A HANDGUN

(71) Applicant: Ward Kraft, Inc., Fort Scott, KS (US)

(72) Inventor: Jesse D. Crum, Fort Scott, KS (US)

(73) Assignee: Ward Kraft, Inc, Fort Scott, KS (US)

( * ) Notice: Subject to any disclaimer, the term of this patent is extended or adjusted under 35 U.S.C. 154(b) by 0 days.

(21) Appl. No.: 14/242,549

(22) Filed: Apr. 1, 2014

(65) Prior Publication Data

US 2014/0338246 A1 Nov. 20, 2014

Related U.S. Application Data

(60) Provisional application No. 61/823,782, filed on May 15, 2013.

(51) Int. Cl.
*F41G 1/02* (2006.01)
*F41G 1/01* (2006.01)

(52) U.S. Cl.
CPC ... *F41G 1/02* (2013.01); *F41G 1/01* (2013.01)
USPC ..... 42/130; 42/133

(58) Field of Classification Search
None
See application file for complete search history.

(56) References Cited

U.S. PATENT DOCUMENTS

| | | | | |
|---|---|---|---|---|
| 189,721 | A * | 4/1877 | Freund | 42/144 |
| 2,891,445 | A * | 6/1959 | Staubach | 356/247 |
| 4,616,421 | A * | 10/1986 | Forsen | 42/130 |
| 5,327,654 | A | 7/1994 | Parker | |
| D478,646 | S | 8/2003 | Wygant | |
| 7,726,229 | B2 | 6/2010 | Schwerman et al. | |
| 7,946,075 | B2 | 5/2011 | Nasef | |
| D681,767 | S | 5/2013 | Li et al. | |
| 8,479,433 | B1 | 7/2013 | Shebaro | |
| 8,635,800 | B2 | 1/2014 | Glimpse et al. | |
| 8,635,801 | B2 | 1/2014 | Glimpse et al. | |
| D700,268 | S | 2/2014 | Hormberg | |
| D701,284 | S | 3/2014 | Grossman et al. | |
| 8,677,674 | B2 | 3/2014 | Glimpse et al. | |
| 2008/0134561 | A1 * | 6/2008 | Clouser | 42/113 |

* cited by examiner

*Primary Examiner* — Stephen M Johnson
(74) *Attorney, Agent, or Firm* — Lathrop & Gage LLP

(57) ABSTRACT

A rotatable, adjustable circular focus sight is installed in a front sight of a handgun. The focus sight has a circular opening that may be rotated to different positions in the front sight to sharpen aiming of the handgun in order to accommodate varying environmental conditions and different types of ammunition. Alternative embodiments of the focus sight incorporate various cross-hair patterns and a pinhole.

12 Claims, 6 Drawing Sheets

ADJUSTABLE FRONT FOCUS SIGHT FOR A HANDGUN

RELATED APPLICATION

This application claim priority to U.S. Patent Application Ser. No. 61/823,782, filed May 15, 2013, the disclosure of which is incorporated herein by reference.

FIELD OF INVENTION

The field of the invention is sights for firearms and, more particularly, front sights for handguns.

BACKGROUND

Various conditions can affect the aiming of a handgun. Wind, for example, can affect the steadiness with which a user can focus on a target. The user may also be in an awkward or cramped space, or have problems getting sufficient footing to be able to steady the handgun while aiming. The wind or lack of a firm footing may make it difficult to steady the handgun and focus the sight on the target. In addition, the user of the handgun may wish to aim the handgun differently depending on the type of ammunition being used or to account for the manner in which the ammunition behaves once it is discharged from the handgun.

It would be useful have an adjustable apparatus to narrow or focus the aim of a handgun so that the user could sharpen the aim regardless of environmental conditions, but especially in conditions in which it is otherwise difficult for the user to focus the aim of the handgun. It would also be useful to have a handgun sight that could be used differently depending on the ammunition being used.

SUMMARY OF INVENTION

A rotatable, adjustable circular focus sight is installed in a front sight of a handgun. The focus sight has a circular opening that may be rotated to different positions in the front sight to sharpen and focus the aiming of the handgun to accommodate different types of ammunition and differing environmental conditions, not only under normal conditions, but also in conditions in which the wind, balance, and other environmental conditions may affect the aiming of the handgun, the steadiness of the user, and/or the accuracy of the discharged slug when the fire arm is discharged. Different parts or areas of the adjustable front sight may also be used differently depending on the different types of ammunition used in the handgun and the distance of the target from the handgun.

DETAILED DESCRIPTION

As used in this description, the terms right, left, up, upper, down, and lower refer to those same positions or directions on the properly oriented upright drawings referenced in the description.

Figure 1:
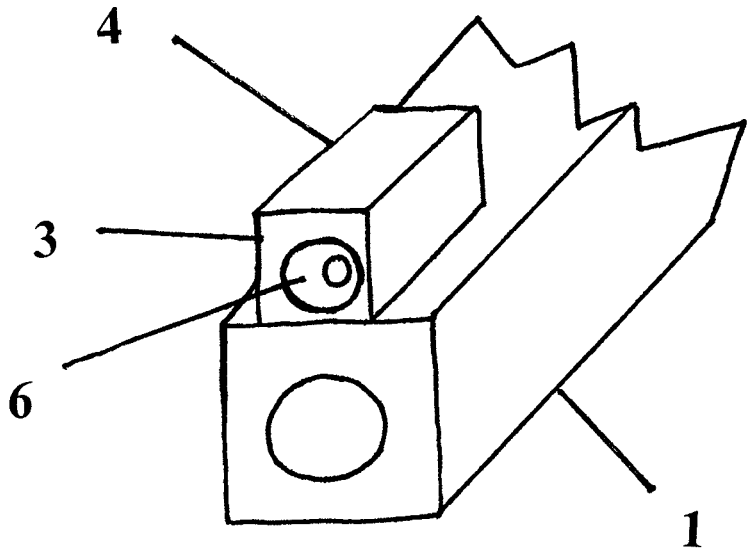
FIG. 1 is a front side perspective view of the front of the barrel of a handgun showing a front sight of the invention.
Figure 2:
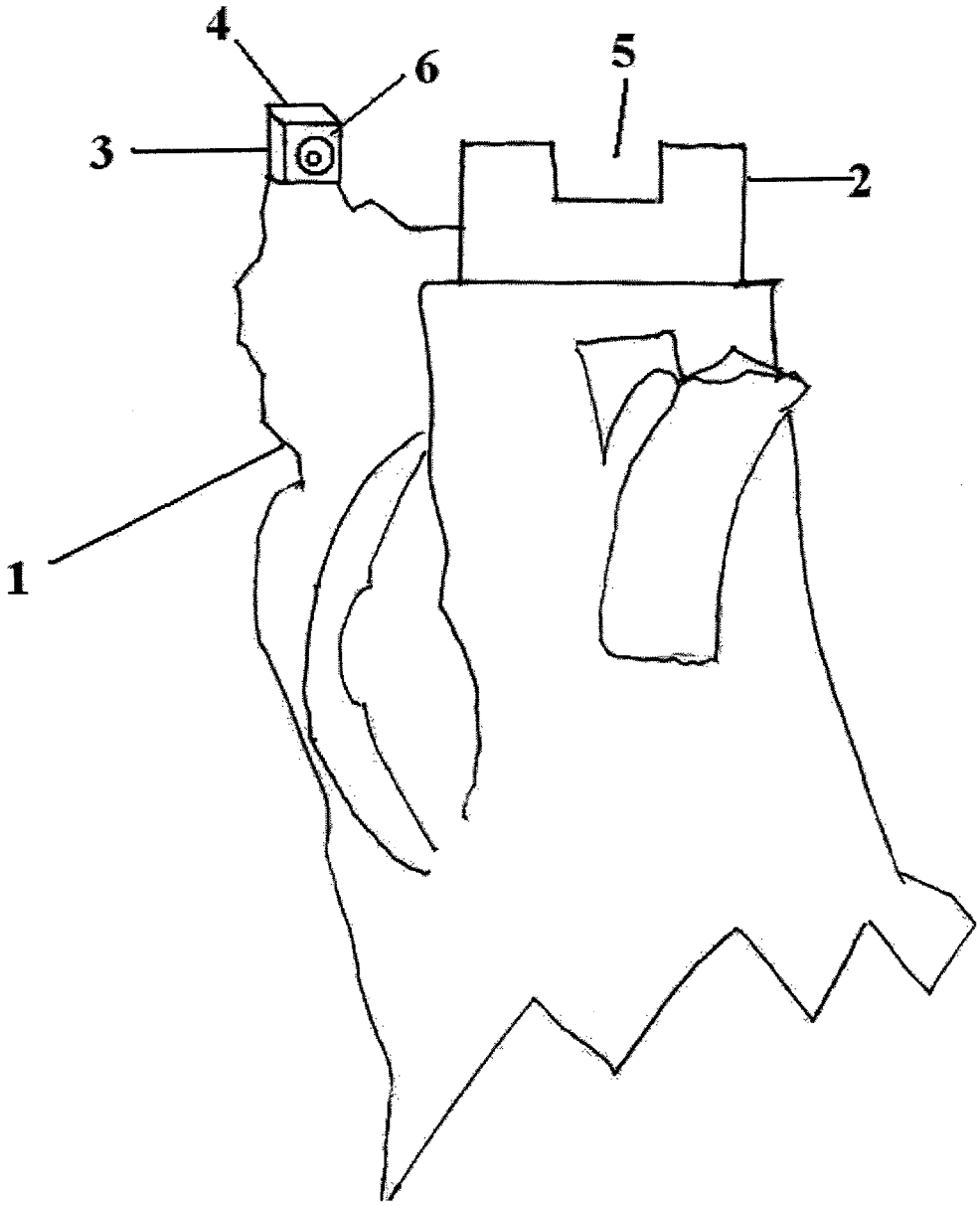
FIG. 2 is a rear perspective view of a schematically represented handgun showing a rear sight and an outer portion of the front sight of the invention.

FIGS. 1 and 2 show a handgun 1 having a rear sight 2 and an outer potion 3 of a front sight 4. The front sight 4 is mounted on a front end of a barrel of the handgun 1. The rear sight 2 is mounted on a rear end of the barrel or other rear structure of the handgun.

The outer portion 3 of the front sight 4 is a rectangular tube having a square cross-section when viewed from either end along its longitudinal axis. The outer portion 3 of the front sight 4 has a centrally located threaded circular hole 6 therethrough. The outer portion 3 of the front sight 4 may also be made in shapes other than rectangular. The outer portion 3 of the front sight 4 may be flat on an upper side thereof and rounded, semicircular, or any other shape on a bottom side, provided suitable means are provided to secure the front sight 4 to the barrel of the handgun 1. The upper side of the front sight 4 may also be shaped to provide another focus point such as a triangle shape, a wedge shape, a depression forming a semicircular depression, or even form another focus hole.

Figure 7:
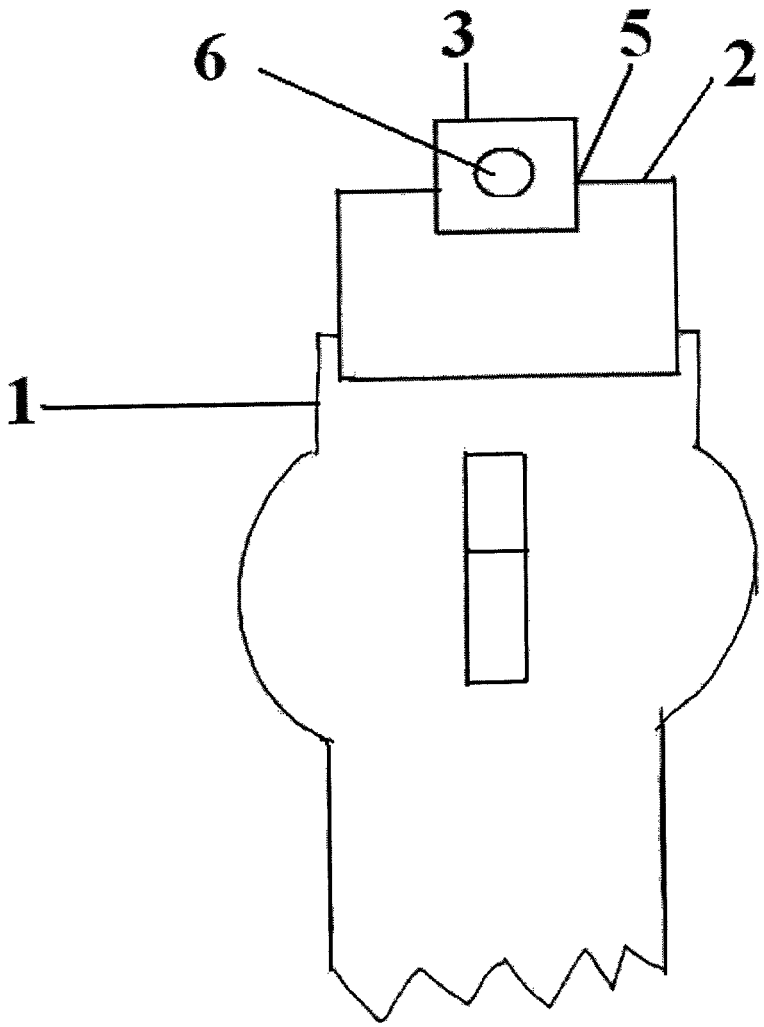
FIG. 7 is a rear view of a schematically represented handgun showing the alignment of the outer portion of the front sight and the rear sight when viewed by a user from the rear of the handgun.

As shown in FIG. 2, the rear sight 2 forms a three sided slot 5 which has a width sufficient to allow the square cross-section of the outer portion 3 of the front sight 4 to fit in and appear to fill the slot 5 when viewed from behind the rear sight 2, as shown in FIG. 7. If the front sight 4 does not have a square cross-section, the rear sight 2 and the slot 5 may have a shape that cooperates with the front sight 4 when viewed from the rear sight 2 such that the font sight 4 appears to fill the slot 5.

The rear sight 2 and the outer portion 3 of the front sight 4 may be made of any suitable, durable material including metal or plastic. Both the rear sight 2 and the outer portion 3 of the front sight 4 may be mounted to the handgun 1 in any suitable fashion know in the art.

The front sight 4 has a threaded circular insert 8 which screws into the threaded circular hole 6 in the front sight 4. The circular insert 8 has a circular focus opening or focus sight 9 therethrough as shown in FIGS. 3, 4 5, and 6. The focus site 9 is an off-center hole in the circular insert 8. The circular insert 8 may be a bolt with an off-center hole drilled through the bolt, or it may be a custom-made threaded insert.

Figure 4:
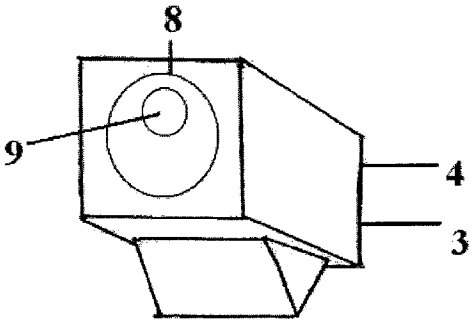
FIG. 4 is a perspective view of the front sight of FIG. 1 showing the adjustable focus sight in a second position.
Figure 6:
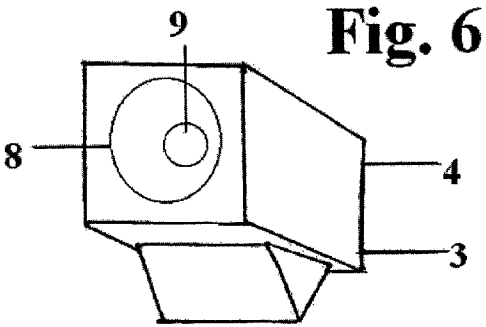
FIG. 6 is a perspective view of the front sight of FIG. 1 showing the adjustable focus sight in a fourth position.
Figure 3:
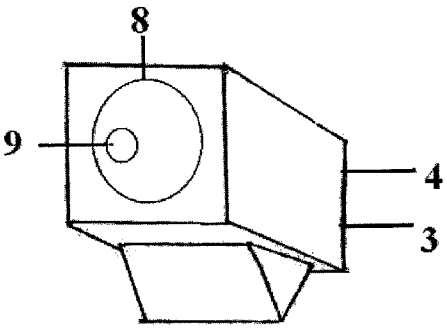
FIG. 3 is a perspective view of the front sight of FIG. 1 showing an adjustable focus sight in a first position.
Figure 5:
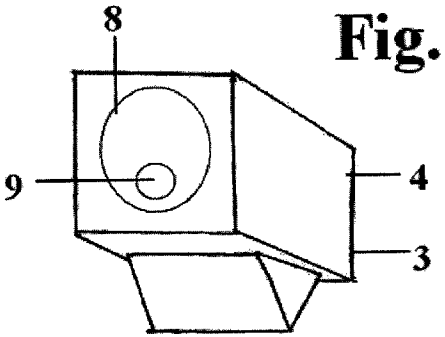
FIG. 5 is a perspective view of the front sight of FIG. 1 showing the adjustable focus sight in a third position.

The insert 8, when threadably rotated, allows the position of the focus opening 9 to be changed. As the insert 8 is rotated, the focus sight 9 may be positioned in a left side of the front sight 4, as shown in FIG. 3, in an upper side of the front sight 4, as shown in FIG. 4, in a lower side of the front sight 4, as shown in FIG. 5, or in a right side of the front sight 4, as shown in FIG. 6. The focus opening 9 may also, via rotation, be positioned in locations between the positions shown in FIGS. 3 through 6.

Figure 8:
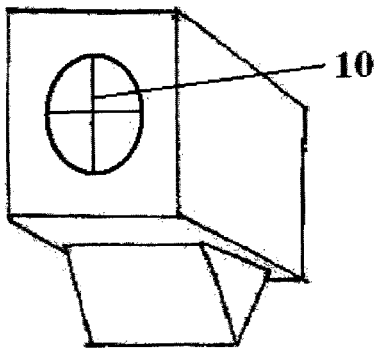
FIG. 8 is an alternative embodiment of the focus sight showing the use of a pattern of cross hairs in the focus sight.
Figure 9:
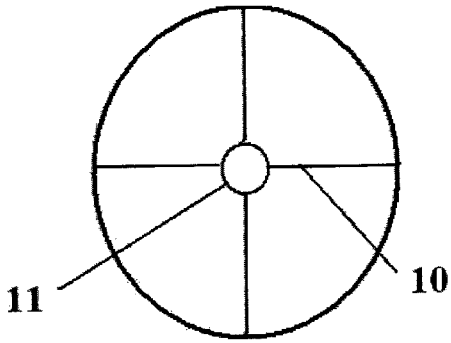
FIG. 9 is an alternative embodiment of the focus sight showing a first alternative pattern of cross hairs in the focus sight.
Figure 10:
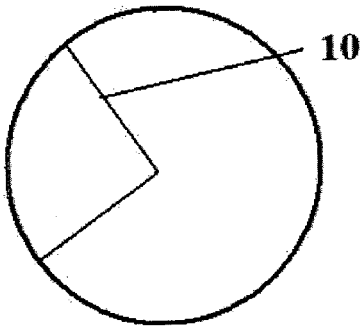
FIG. 10 is an alternative embodiment of the focus sight showing a second alternative pattern of cross hairs in the focus sight.
Figure 11:
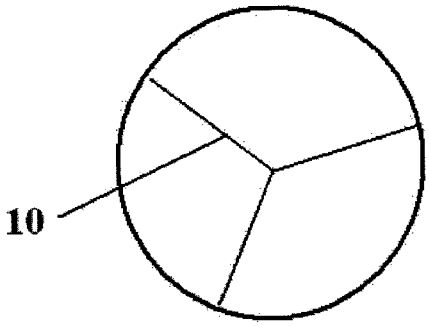
FIG. 11 is an alternative embodiment of the focus sight showing a third alternative pattern of cross hairs in the focus sight.
Figure 12:
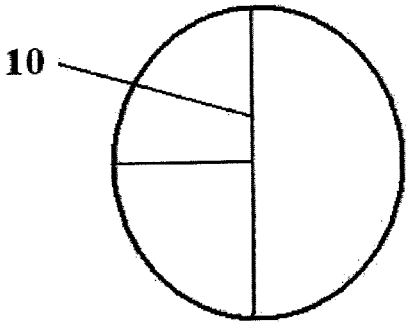
FIG. 12 is an alternative embodiment of the focus sight showing a fourth alternative pattern of cross hairs in the focus sight.
Figure 13:
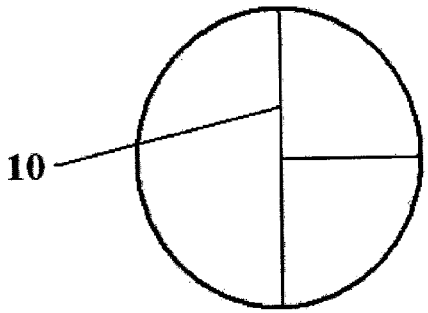
FIG. 13 is an alternative embodiment of the focus sight showing a fifth alternative pattern of cross hairs in the focus sight.

In an alternative embodiment, the insert 8 and focus opening 9 may be augmented by cross hairs 10 of various patterns, as shown in FIGS. 8, 9, 10, 11, 12, and 13. The cross hairs 10 may be installed using metal wires securely connected to the insert 8 and extending across the focus opening 9. If the cross hairs 10 are used, the focus opening 9 may be made either off-center in the insert 8 or in the center of the insert 8. The cross hairs 10 may be in a variety of patterns as shown in FIG. 8 (intersection lines across entire focus sight opening 9), FIG. 11(angled lines), FIGS. 12 and 13 (T-shaped in two different rotated positions). As shown in FIG. 9, in an alternate embodiment, the focus opening 9 may also be a pinhole 11 in the center of the insert 8 so as to provide an option for pin point aiming.

Depending on the weight of the slug of the ammunition, the distance of the handgun 1 from the target, and the speed of the slug as it leaves the barrel of the handgun 1, the arc and path of the slug may vary. It has been found that the front sight 4 may be used to adjust for such differences. In the case of a lighter weight slug, such as a Delrin® slug, it is found that the focus sight 9 at a central location in the front sight 4 may be used quite satisfactorily and accurately at shorter distances due to the increased initial speed of the Delring® slug.

Figure 14:
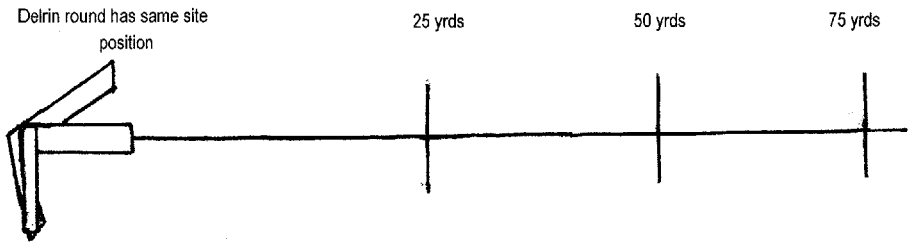
FIG. 14 is a schematic showing the short range effect of the use of a Delrin® slug on the arc of the ammunition discharged from a handgun.
Figure 15:
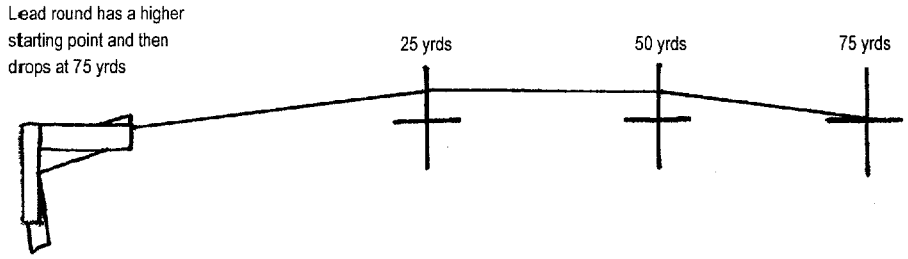
FIG. 15 is a schematic showing the short range effect of the use of a lead slug on the arc of the ammunition discharged from a handgun.

As shown schematically in FIG. 14, the Delrin slug, due to its greater speed at the time of its discharge from the handgun 1, will likely have less drop in the first 25-50 yards after it has been discharged from the barrel of the handgun 1; thus the focus sight 9 may be placed in a central location in the front sight 4. With metal slugs, such as lead, it has been found that the arc of the slug will manifest itself more quickly due to the reduced speed of the slug, as shown schematically in FIG. 15. Accordingly, the focus sight 9 may be adjusted to the upper side (see FIG. 4) of the front sight 4 when a lead slug is used. In the alternative, with a heavier slug, such as lead, it has been found that the top surface of the outer portion 3 of the front sight 4 may be used to aim the handgun 1 and, thus, accommodate the additional drop of the lead slug on its way to a short or medium range target.

In use, the user of the handgun 1 may rotate the insert 8 in the central circular hole 6 of the front sight 4 to adjust the position the focus opening 9 in the insert 8 when the user is aiming the handgun 1. The focus sight 9 is particularly useful when the user of the handgun 1 must adjust for wind, terrain, and other environmental conditions. In such conditions the user may have unsteady footing or the environmental conditions may cause the user to move or be unable to steady the handgun 1. The use of the focus sight 9 allows the user to pinpoint the target in the focus sight 9 and get a better aim on the target before discharging the handgun 1.

In addition, the focus sight 9 allows the user to adjust the aim for wind conditions, for example, rotating the focus sight 9 to a left or right position to adjust for a cross wind, or up and down for distance and bullet drop conditions after firing. The use of the focus sight improves the accuracy of shots made by a user, as the user must steadily focus through the focus sight 9 before discharging the handgun 1. In addition, the focus sight 9 is useful for aiming of the handgun 1, even when the user is not in a difficult position or conditions to aim the handgun 1. The adjustable focus sight 9 causes the user to focus more carefully in all aiming, and is thus useful in all conditions. In all of the uses described above, the cross hairs 10 option may be used. Moreover, as described above, the focus sight 9 may be used to compensate for the effects of the weight and aerodynamic aspects of different kinds of ammunition.

Indeed, the front site 4 may be used with a number of different inserts 8 and/or cross hair 10 patterns in order to provide the user with numerous aiming options. The inserts 8, due to their threading, can be easily removed and replaced in the field with a different inserts 8, as desired by the user.

Although this description references handguns, the front sight may also be used on other types of firearms such as rifles and shotguns.

I claim:

1. A front sight for a handgun comprising:

(a) a tube mounted to a front of a barrel of the handgun, the tube having a square cross-section along a longitudinal axis of the tube;

(b) the tube forms a central threaded hole;

(c) an insert threadably received in the central threaded hole of the tube, the insert forming an off-center focus sight opening therethrough; and (d) the insert is rotated to adjust the location of the focus sight opening to a plurality of positions within the central threaded hole in the tube.

2. The front sight of claim 1 wherein the insert is a bolt with a hole therethrough.

3. The front sight of claim 1 wherein the front sight fills a slot in a rear sight of the handgun when viewed from behind the rear sight.

4. The front sight of claim 1 wherein the focus site is a pinhole in a center of the insert.

5. The front sight of claim 1 wherein the tube is rectangular.

6. The front sight of claim 1 made of metal.

7. The front sight of claim 1 made of plastic.

8. The front sight of claim 1 wherein the insert has one or more cross-hairs installed therein.

9. The front sight of claim 8 wherein the insert has angled cross-hairs.

10. The front sight of claim 8 wherein the insert has cross-hairs in an angled pattern.

11. The front sight of claim 8 wherein the insert has cross-hairs in a T-shaped pattern.

12. The front sight of claim 8 wherein the insert has cross-hairs in a pattern of intersecting lines across the entire opening of the insert.

* * * * *